United States Patent [19]

Knijpstra

[11] Patent Number: 4,988,089

[45] Date of Patent: Jan. 29, 1991

[54] FAIRGROUND ATTRACTION

[75] Inventor: Hette Knijpstra, Terband, Netherlands

[73] Assignee: Knijpstra Konstruktie B.V., Terband, Netherlands

[21] Appl. No.: 422,580

[22] Filed: Oct. 17, 1989

[30] Foreign Application Priority Data

Mar. 23, 1989 [NL] Netherlands ..... 8900728

[51] Int. Cl.[5] ..... A65G 1/00

[52] U.S. Cl. ..... 272/29; 272/49

[58] Field of Search ..... 272/29, 49, 38; 280/413

[56] References Cited

U.S. PATENT DOCUMENTS

| | | | |
|---|---|---|---|
| 2,590,934 | 4/1952 | Catlett | 272/29 |
| 2,847,216 | 8/1958 | Courtney | 272/29 X |
| 2,907,568 | 10/1959 | Velare et al. | 272/29 |
| 3,002,753 | 10/1961 | Garbrick | 272/29 |
| 3,222,061 | 12/1965 | Eyerly et al. | 272/29 |
| 3,456,943 | 7/1969 | Brown | 272/29 |
| 3,552,747 | 1/1971 | Deem | 272/29 |

*Primary Examiner*—Richard E. Chilcot, Jr.

*Attorney, Agent, or Firm*—Griffin Branigan & Butler

[57] ABSTRACT

A fairground attraction transportable in parts, comprising two or more parts transportable in folded condition on separate carriages or containers. The carriages are provided with means for lateral and longitudinal displacement.

21 Claims, 7 Drawing Sheets

FAIRGROUND ATTRACTION

This invention relates to a fairground attraction which can be transported in parts.

In such a fairground attraction known from Dutch patent application No. 72,14759, use is made of a construction wherein on each of the radial main spokes there is mounted a junction element from which again further spokes extend to the shafts carrying the cars or gondolas. In this manner, true, there is obtained a simplification but a comparatively large amount of assembly and disassembly operations have still to be carried out for displacing and re-assembling the attraction. Moreover, large associated baseplates to be anchored to the ground have each time to be transported along. Moreover, a large number of containers or carriages is necessary for the transport.

It is an object of the present invention to remove these drawbacks.

To that end, the fairground attraction is characterized in that it comprises two or more parts that can be transported in folded up condition on separate carriages, with the carriages serving as a foundation. This also means that the build-up of the attraction proper starts already at a given height above ground level, which is important especially for high attractions.

The carriages may then be provided, at least partly, with means for lateral displacement thereof. Naturally, it is also possible to provide the carriages with means for forward or backward movement thereof. As a result, the parts from which the fairground attraction is built up can be positioned very accurately with respect to each other.

Said means for lateral or forward and backward movement of the carriages may then consist of lift cylinders and a drawbar or push rod fitted with cylinders.

The lift cylinders can be connected rotatably with their upper ends to the chassis of the carriage and be supported with their lower ends on the ground, while the cylinder-fitted drawbar or push rod arranged at an angle to the lift cylinders on the one hand is connected rotatably to the carriage to be displaced and on the other hand is supported on the ground.

The present invention further relates to a fairground attraction, in particular a giant wheel, which is characterized in that it includes two or more parts, each provided with means for displacement thereof.

Each side portion can be provided with two carrier portions that can be folded down. The upper ends of the carrier portions can be coupled through a main shaft on which the spokes of the giant wheel can be rotatably mounted.

The circumferentially successive spokes of the giant wheel can be interconnected at their ends by crossheads whose outer sides are arranged for coaction with a drive mechanism.

One of the carrier portions can be connected and remain connected rotatably to the carriage and the other portion can be connected detachably to the carriage, while furthermore the free ends of the two portions can be interconnected rotatably. The carrier portion connected rotatably to the carriage can then be brought from a lying transport position into the upright position of use through a lift cylinder. Said coupled carrier portions can then be brought from the lying position first into an approximately vertical position, in which the two portions can be uncoupled at the one end, after which the portions can be moved to the position of use and fixed.

In a further elaboration of the present invention, at the ends of the outer carriages, there may be provided a strut connected rotatably to the carriage and fitted with a telescopic support. The end of each carriage can likewise be provided with a device for coupling a juxtaposed carriage. A coupling panel may be provided at the coupling location.

A convenient assembly, moreover, is obtained when the spokes are coupled two by two at their one end to a connecting plate connectible to the main shaft, thereby substantially reducing the assembly and disassembly operations.

By rendering the coupled spokes nestable, they occupy very little space for the transport. It has been found that the spokes destined for a giant wheel of about 30 m. in height, can be transported in stacked condition in a container on wheels having a length equal to that of the spokes and having a height of at most 4 m., being the maximum vehicle height in most countries. This concerns a giant wheel having 26 spokes, i.e. also 26 cars, each of which accommodating four to six persons.

For the sake of completeness, reference is made to Dutch patent specification No. 177,732, disclosing a giant wheel construction, wherein the spokes each consist of parts foldable or rotary relatively to each other. The parts, after disassembly, can be received in a container which, in this known giant wheel, likewise serves as a storage space during transport. Further similarities with the apparatus according to the present invention are lacking, however.

One embodiment of a giant wheel according to the invention will now be described, by way of example, with reference to the accompanying drawings, in which.

Figure 1:
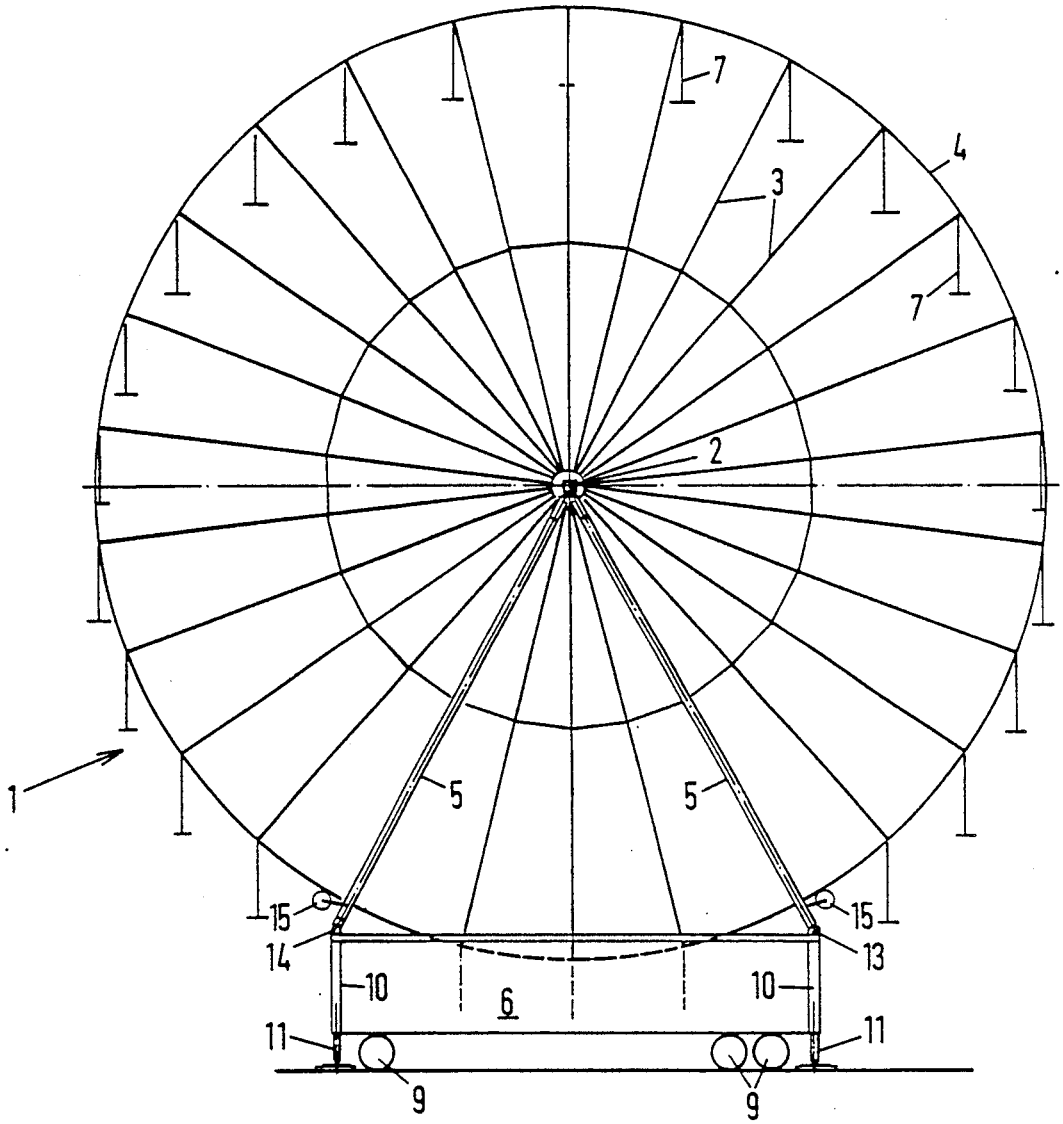
FIG. 1 is a side view of a giant wheel.
Figure 2:
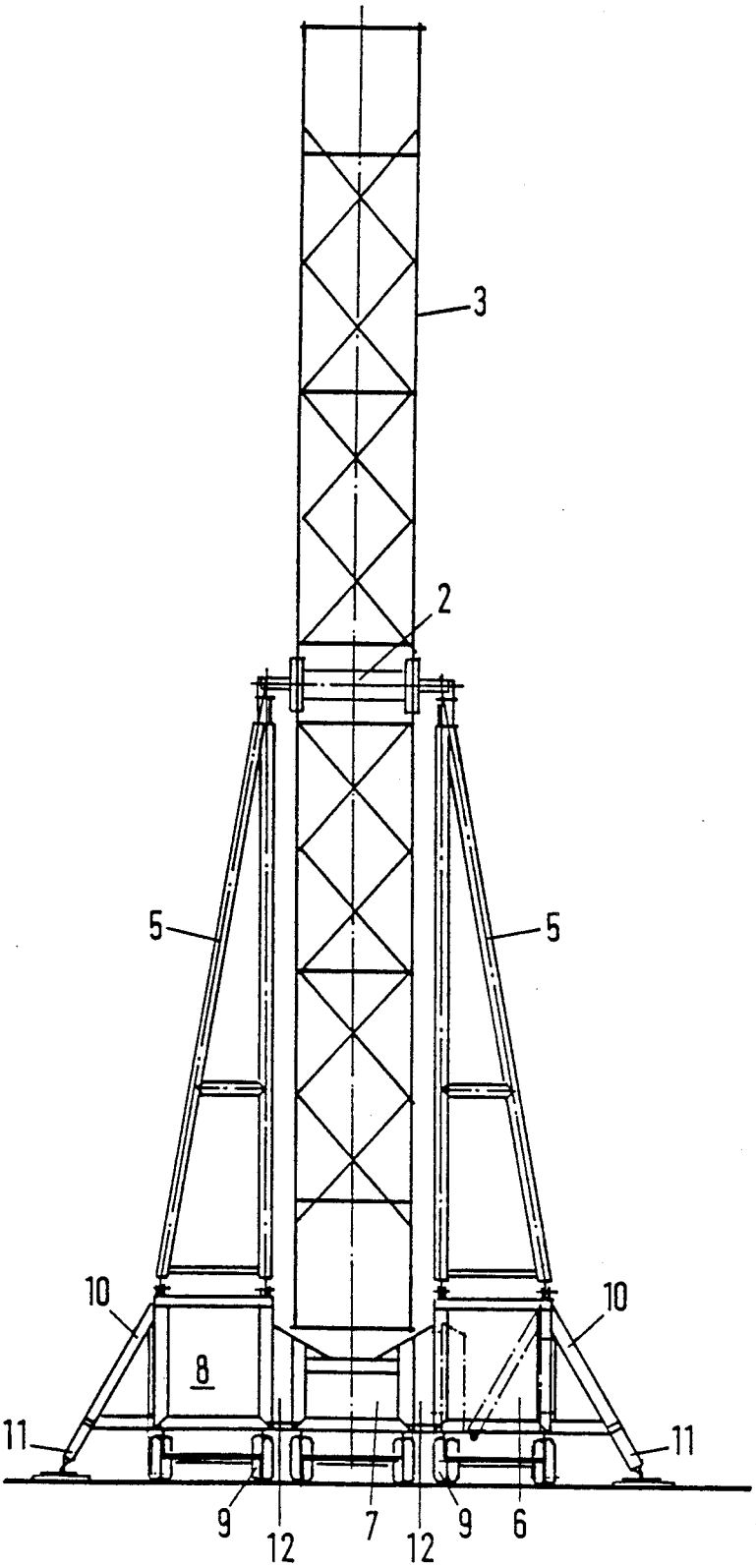
FIG. 2 is a front view of the giant wheel of FIG. 1.
Figure 3:
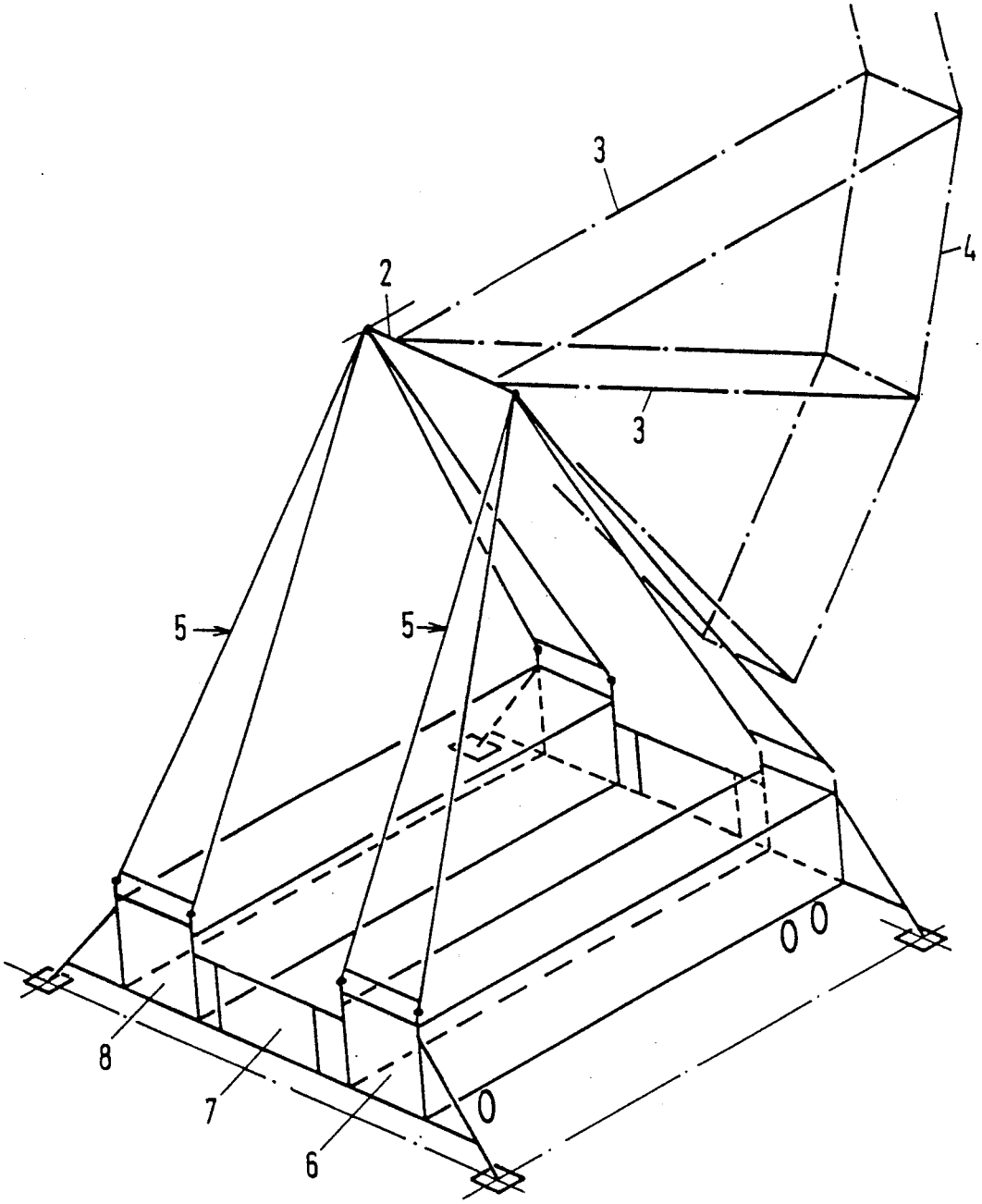
FIG. 3 is a perspective, diagrammatic view of the giant wheel according to FIGS. 1 and 2.
Figure 4A:
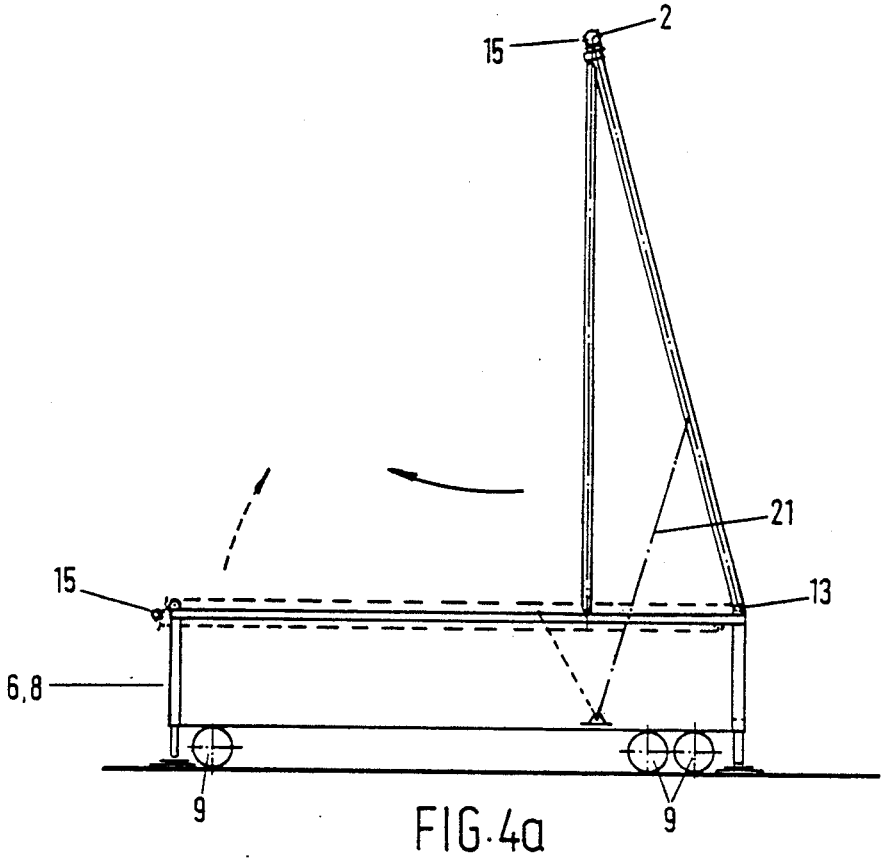
Figure 5A:
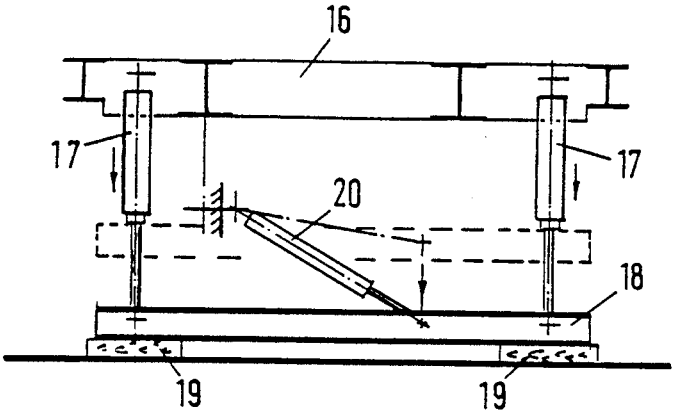
Figure 6:
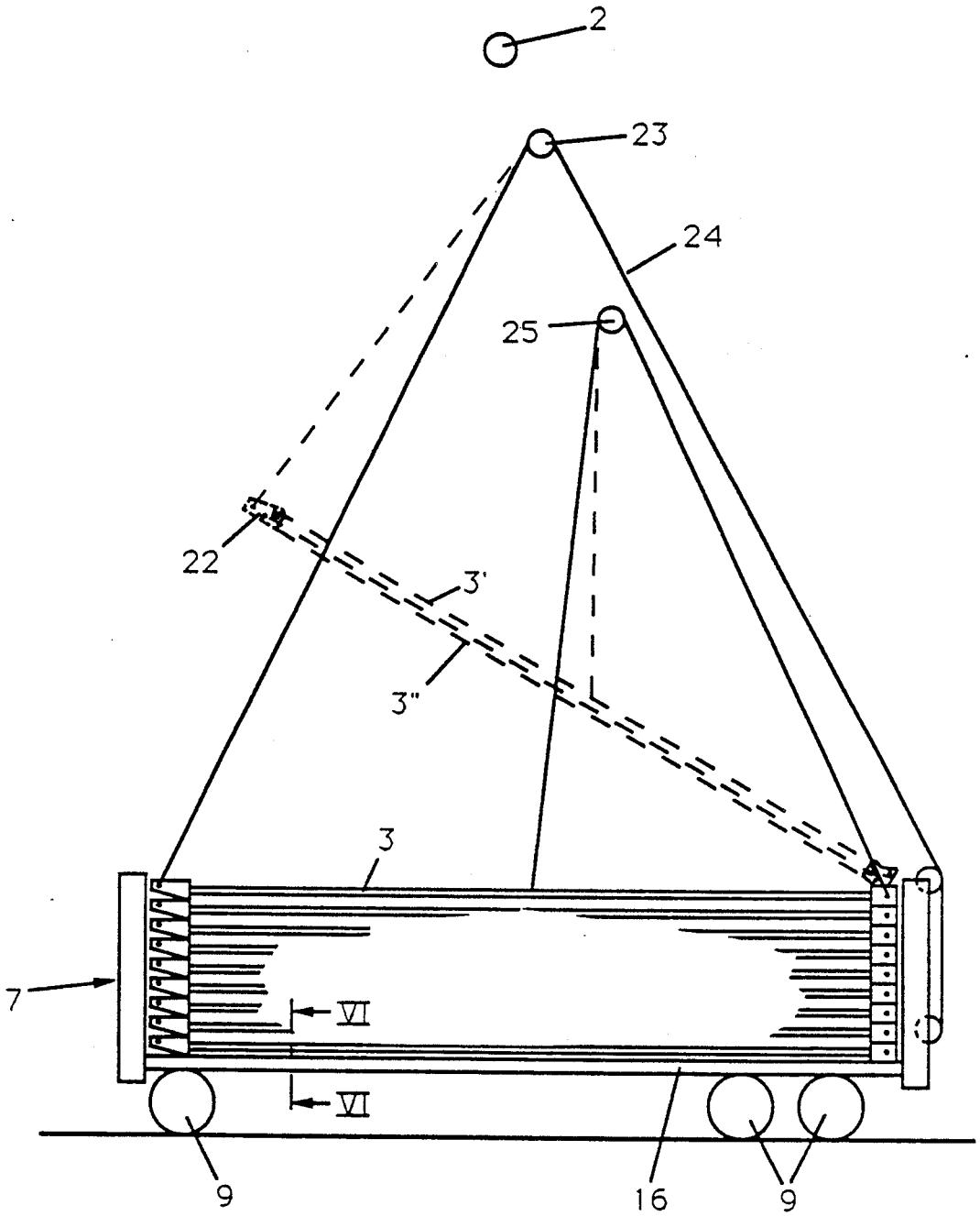
Figure 7:
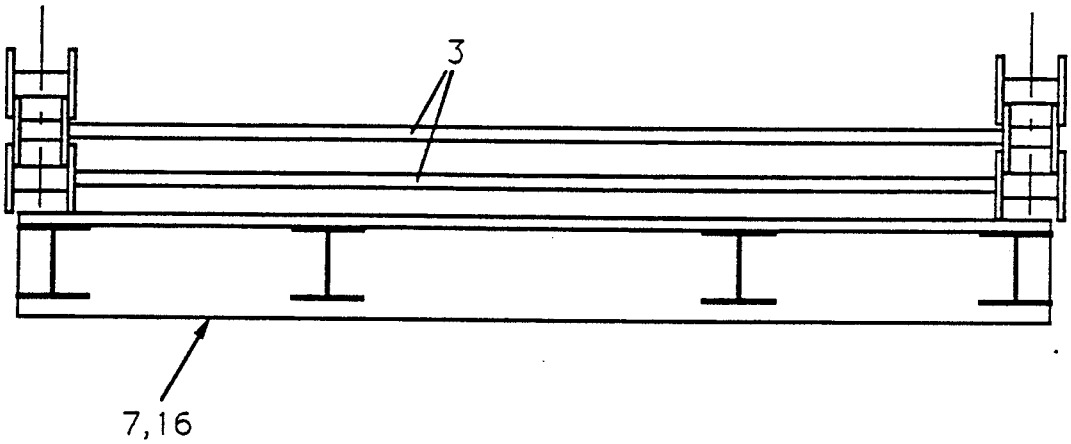
Figure 8:
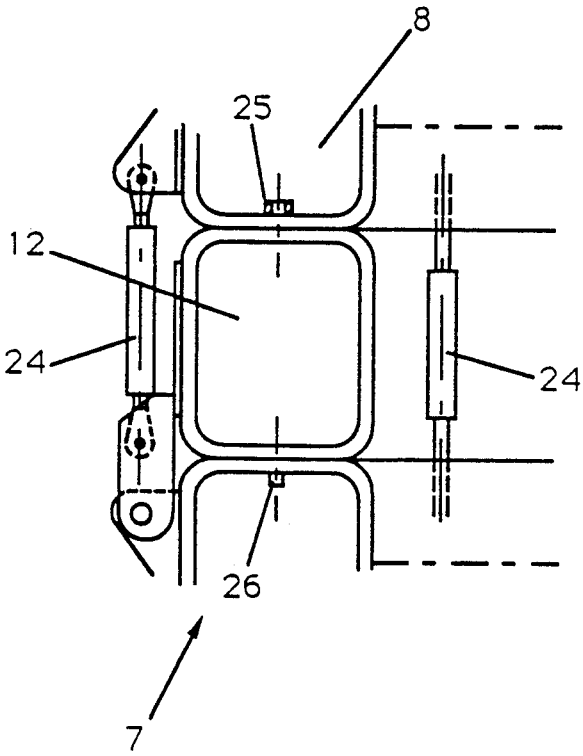

FIGS. 4*a* and *b* are diagrammatic side views of the giant wheel according to FIGS. 1–3 during assembly of the carrier portions;

FIGS. 5*a*, *b* and *c* are detail views of the giant wheel during lateral displacement of one of the juxtaposed carriages;

FIG. 6 shows the spokes of the above described giant wheel in stacked condition;

FIG. 7 is a cross-sectional view taken on the line VII—VII of FIG. 6; and FIG. 8 is an elevational view of the mutual anchoring of two justaposed containers or carriages.

As shown in the drawings, see in particular FIGS. 1, 2 and 3, a giant wheel 1 comprises a main shaft 2 on which are mounted a plurality of spokes 3 of known per se construction and which are interconnected at their free ends by crossheads 4.

The main shaft 2 is supported, in the present case, by four carrier portions 5, being provided at their free ends with bearing brasses, not further indicated, for supporting main shaft 2.

At the junction of crossheads 4 with the ends of spokes 3, there is mounted a carrying bar 7. Suspended from the free end of each carrying bar 7 is a known per se car or gondola, not shown, destined for accommodating one or more persons.

As mainly shown in FIGS. 2 and 3, the giant wheel is provided with three containers 6,7 and 8. Containers 6 and 8 rotatably support two carrier portions 5. The carrier portions mounted on containers 6 and 8 support the main shaft 2.

The central container serves for the storage and the transport of spokes 3.

As shown in the drawings, containers 6,7 and 8, respectively, are mounted on a plurality of shafts having tyres 9.

The two outer carriages or containers 6,8 are rotatably provided with a support construction 10, whose two ends are fitted with struts 11 connected telescopically thereto. The ends of the outer carriages or containers can be provided at their other end with a rotatably connected coupling panel 12. The containers or carriages 6 and 7, and 7 and 8, respectively, can further be interconnected through a bolt-and-nut construction through which these parts can be pulled firmly against each other, with the coupling panel 12 ensuring the proper interspace.

Figure 4B:
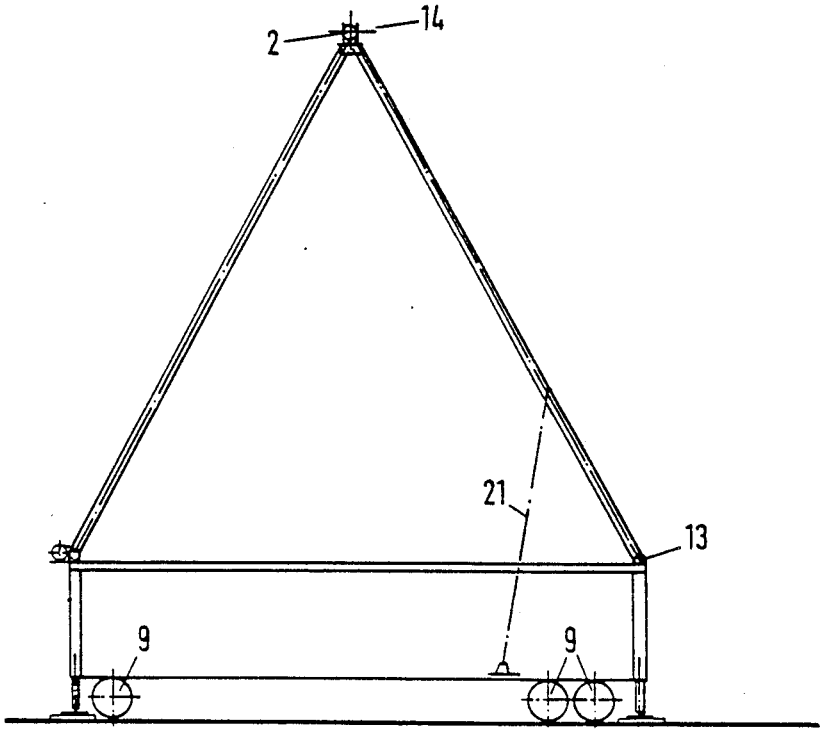

The manner of "hoisting out" the carrier portions is shown diagrammatically in FIGS. 4*a*, 4*b*. Carrier portions 5 are constructed in such a manner that they can be properly nested in lying condition, as illustrated in dashed lines in FIG. 4*a*. The upper carrier portion is always erected, because the one end thereof is connected fixedly but rotatably to the container. The respective pivot is illustrated at 13 in FIG. 4. The cylinder-fitted lifting rod is shown diagrammatically by a dash-dot line at 21. The upper ends of the carrier portions are interconnected rotatably by means of a diagrammatically shown bearing 15 adapted to receive main shaft 2. Main shaft 2 is mounted in lying condition of the carrier portions, whereafter the carrier portions are hoisted synchronously, but it will be clear that also other assembly methods can be used.

It is observed with reference to FIG. 1, that the exteriors of crossheads 4 are adapted for coaction with one or more drive wheels 15 driven by means, not shown. However, it is clear that the drive of the crossheads can be effected also differently. For instance, the crossheads may be provided with a toothed rack adapted to mesh with pinions.

FIG. 3 diagrammatically shows how two juxtaposed spokes 3 are connected to main shaft 2, while crossheads 4 are provided between the free ends of the spokes.

For a correct positioning of the containers or carriages 6,7,8, they can be fitted with a lateral displacement device, also called traveling device, comprising piston-and-cylinder assemblies 17 rotatably connected to a chassis 16 of a container, not further shown. In FIG. 5, the free ends of the piston-and-cylinder assemblies 17 are connected rotatably to a supporting beam 18, which can be supported on the ground by interposition of e.g. wooden beams 19.

As further shown in FIG. 5, chassis 16 is provided with a piston-and-cylinder assembly 20, arranged at an angle to piston-and-cylinder assemblies 17, the other end of said assembly 20 being connected rotatably to supporting beam 18.

The operation of the construction is as follows.

From a starting position of supporting beam 18, shown in dashed lines in FIG. 5*a*, the piston-and-cylinder assemblies 17 are brought under pressure and hence chassis 16 is moved upwards until the wheels, not further shown, are approximately clear of the ground.

Figure 5B:
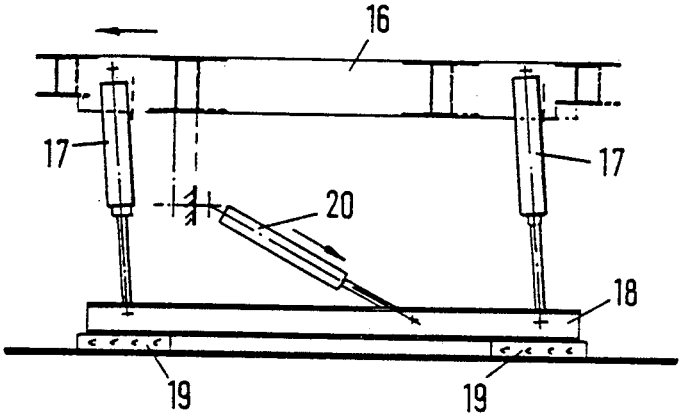
Figure 5C:
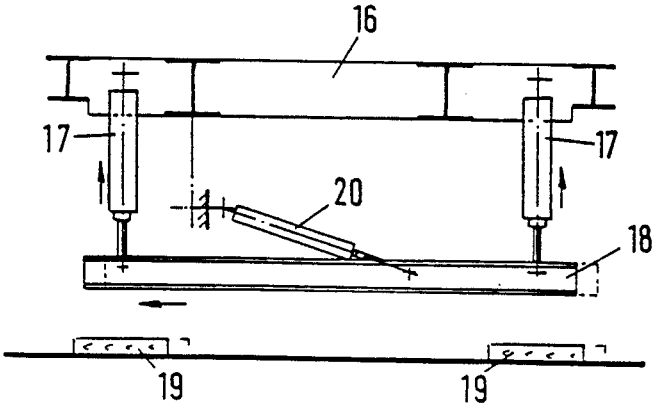

By subsequently bringing piston-and-cylinder assembly 20 under pressure, chassis 16 is displaced laterally relatively to supporting beam 18 (FIG. 5*b*). By thereafter relieving piston-and-cylinder assemblies 17, supporting beam 18 will be moved upwards and subsequently the supporting beam will move to the left and occupy again a normally vertical position underneath chassis 16, after which the cycle can be restarted.

FIGS. 6 and 7 separately show two coupled spokes 3. As shown in these figures, the spokes are interconnected at their one end by means of a connecting piece 22. The spokes are constructed in such a manner that they are nestable, as clearly shown in FIG. 7.

As shown in FIG. 6, the spokes essentially consist of a main spoke 3′ and a short spoke 3″. Said connecting piece 22 is integral with main spoke 3′, while the short spoke 3″ is connected rotatably to connecting piece 22. At the other end, both the main spoke and the short spoke are provided with flange-shaped ends adapted for assembly of a crosshead 4 therebetween.

The assembly of the spokes on the main shaft takes place in a manner similar to that described above with respect to the assembly of the carrier portions. At the location of the upper end, in mounted condition, of one of the carrier portions 5, a roller 23 is mounted on one thereof, over which roller 23 extends a cable 24 whose one end is connected to a winch, not further shown, mounted on the container, while the other end is connectible to the said coupling plate 22. In this manner, the coupled ends of spokes 3′, and 3″, respectively, can be moved upwards and be connected to the main shaft. For the sake of convenience, to that end, an auxiliary roller 25 is disposed underneath roller 23, the one end of said auxiliary roller being connected to a winch, while the other end is adapted to engage with the centre of the main spoke. This auxiliary roller is desirable, because the spoke can then be mounted more easily in its approximately vertical position on main shaft 2. In FIGS. 6 and 7, the parts not necessary for a proper understanding have been omitted.

FIG. 8 shows the connection of a lateral container or carriage 8 to the central container or carriage 7, between which coupling panel 12 is present. In order to apply the required coupling forces, a bolt-and-nut construction 24 is provided both inside and outside of the coupling panel. As shown in FIG. 8, the left or outer nut construction is connected rotatably to container 8 and connected detachably to container 7. To ensure a proper fixation against occurring lateral forces, the container and panel walls are provided with a wedge construction 25 and a pin construction 26, which constructions are known per se and therefore not shown in detail.

I claim:

1. In a portable Ferris wheel apparatus for use in amusement parks and the like, having a main shaft for the wheel, carrier supports for carrying a bearing for the main shaft, spokes radiating from the bearing, crosshead members for connecting to the free ends of the spokes and carrying bars supported by the cross-head members and spokes for carrying a passenger car or gondola, the improvement comprising three wheeled carriages of a size and configuration such that the carriages may be transported on a public road and placed in side-by-side relationship to each other on ground at which they are to rest when the Ferris wheel is to be erected and operated, a first of said carriages being configured so as to be positionable as a first outer carriage, a further of said carriages being configured so as to be positionable as a further outer carriage, and a second carriage being configured so as to be positionable as a second inner carriage between said first and further outer carriages, the first outer carriage and the further outer carriage being configured so as to contain the carrier supports and having carrier supports lifting means for lifting from and replacing in the said first and further outer carriages the said carrier supports and the second inner carriage being configured so as to contain the spokes and having spoke lifting means for lifting from and replacing in said second inner carriage the spokes.

2. The apparatus of claim 1 wherein the carriages are trucks or trailers for trucks.

3. The apparatus of claim 1 wherein the carrier supports lifting means is a piston-in-cylinder means.

4. The apparatus of claim 1 wherein each of two spokes are connected at ends thereof to a coupling plate which plate is in turn connectable to said main shaft.

5. The apparatus of claim 4 wherein said coupled spokes are nestable.

6. The apparatus of claim 5 wherein the nestable spokes are nestable in said inner carriage.

7. The apparatus of claim 1 wherein the spoke lifting means comprises a roller mounted on at least one carrier support near an upper end thereof and at least one auxiliary roller mounted intermediate of the ends of the carrier support when said carrier support is in an operational position, whereby ropes and cables are passable over said rollers and attachable to said spokes for lifting the said spokes from and replacing the spokes into the said inner carriage.

8. The apparatus of claim 1 wherein the carrier supports are foldable at the ends which are attachable to said bearing and when positioned in the carriage for transportation thereof are in a folded condition.

9. The apparatus of claim 1 wherein at least one of the carriages has a self-contained displacement means for laterally or longitudinally displacing the carriage relative to the ground on which it rests for accurate placement of the carriage in the said side-by-side relationship.

10. The apparatus of claim 9 wherein the displacement means comprises lift cylinders for lifting the carriage from the ground sufficiently that the said wheels of the carriages no longer touch the ground and at least one cylinder-fitted push rod for laterally or longitudinally displacing the carriage while the said wheels do not touch the ground, said lift cylinders being capable of thereafter lowering the carriage until the said wheels again touch the ground.

11. The apparatus of claim 10 wherein the lift cylinders are rotatably connected at upper ends to a chassis of the carriage and supported at lower ends on the ground, and the cylinder-fitted push rod is positioned at an angle to the lift cylinders and rotatably connected at one end to the carriage and the other end thereof is supported on the ground.

12. The apparatus of claim 1 wherein the second inner carriage has a self-contained displacement means for laterally or longitudinally displacing the carriage relative to the ground on which it rests for accurate placement of the carriage in the said side-by-side relationship.

13. The apparatus of claim 1 wherein said outer carriages have struts rotatably connected to the outer carriages for bracing the carriages with the ground.

14. The apparatus of claim 13 wherein the struts are telescopically adjustable.

15. The apparatus of claim 1 wherein said outer carriages have coupling means for coupling the carriages together when the carriages are in positions for erection and operation of said ferris wheel.

16. The apparatus of claim 15 wherein the coupling means is a coupling panel.

17. The apparatus of claim 1 wherein said inner carriage has coupling means for coupling the inner carriage to said outer carriages.

18. The apparatus of claim 17 wherein the coupling means is a coupling panel.

19. The apparatus of claim 1 wherein the first and further outer carriages have substantially rectangular containers with upstanding walls disposed thereon, which containers have perimeter configurations substantially the same as the perimeter configurations of the carriages, and the carrier supports have first ends pivotably attached to adjacent uppermost corners of the container walls and second ends attachable to other adjacent uppermost corners of the container walls, whereby when said carrier supports are disposed in said containers, the containers have free space below the said carrier supports.

20. The apparatus of claim 19 wherein each carrier support has at least a first carrier portion and a second carrier portion with each carrier portion having first ends pivotably attached to adjacent uppermost corners of the container walls and second ends attachable to other adjacent uppermost corners of the container walls.

21. The apparatus of claim 20 wherein the first carrier portion and the second carrier portion are rotatably interconnected at upper ends thereof.

* * * * *